US010407899B2

(12) United States Patent
Klein et al.

(10) Patent No.: US 10,407,899 B2
(45) **Date of Patent: *Sep. 10, 2019**

(54) JOINT-SEALING TAPE WITH PREDETERMINED GEOMETRY AND SEALING ARRANGEMENT WITH SUCH JOINT SEALING TAPE

(71) Applicant: HILTI AKTIENGESELLSCHAFT, Schaan (LI)

(72) Inventors: Manfred Klein, Kaufering (DE); Christian Foerg, Lamerdingen (DE); Markus Koegler, Buchloe (DE); Mario Paetow, Igling (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 0 days.

This patent is subject to a terminal disclaimer.

(21) Appl. No.: 15/547,553

(22) PCT Filed: Feb. 5, 2016

(86) PCT No.: PCT/EP2016/052464
§ 371 (c)(1),
(2) Date: Jul. 31, 2017

(87) PCT Pub. No.: WO2016/128306
PCT Pub. Date: Aug. 18, 2016

(65) Prior Publication Data

US 2018/0202147 A1 Jul. 19, 2018

(30) Foreign Application Priority Data

Feb. 13, 2015 (EP) ..... 15155103

(51) Int. Cl.
*E04B 1/68* (2006.01)
*E04B 2/74* (2006.01)
(Continued)

(52) U.S. Cl.
CPC ..... *E04B 1/6809* (2013.01); *E04B 1/6812* (2013.01); *E04B 1/6813* (2013.01);
(Continued)

(58) Field of Classification Search
CPC ..... Y10S 277/921; E06B 1/62; E06B 1/34; E04B 2/82; E04B 2/825; E04B 2/7411; E04B 2/7457
See application file for complete search history.

(56) References Cited

U.S. PATENT DOCUMENTS 1,625,764 A * 4/1927 Bosley ..... E06B 7/22 112/417
1,893,399 A * 1/1933 Stewart ..... F25D 23/087 280/153.5
(Continued)

FOREIGN PATENT DOCUMENTS

DE 25 31 543 A1 2/1977
DE 2531543 A1 * 2/1977 ..... E04B 2/82
(Continued)

OTHER PUBLICATIONS

International Search Report dated Apr. 13, 2016 in PCT/EP2016/052464 filed Feb. 5, 2016.

*Primary Examiner* — Adriana Figueroa
(74) *Attorney, Agent, or Firm* — Grüneberg and Myers PLLC

(57) ABSTRACT

A joint-sealing tape for sealing a joint between a first building part and a second building part contains an elongated connecting element and at least two sealing elements which have a predetermined geometry and are positioned on the connecting element, spaced apart, side-by-side and running in the longitudinal direction of the connecting element.

17 Claims, 6 Drawing Sheets

(51) Int. Cl.
*E04B 2/82* (2006.01)
*E04B 1/94* (2006.01)

(52) U.S. Cl.
CPC ..... *E04B 1/948* (2013.01); *E04B 2/7411* (2013.01); *E04B 2/7457* (2013.01); *E04B 2/82* (2013.01); *E04B 2/822* (2013.01); *E04B 2/7409* (2013.01); *E04B 2001/6818* (2013.01)

(56) References Cited

U.S. PATENT DOCUMENTS 2,347,158 A * 4/1944 Louis ..... B68G 7/105 36/57
2,592,861 A * 4/1952 Close ..... E06B 7/2316 49/469
5,213,346 A * 5/1993 Thomson ..... F16J 3/02 277/315
5,277,954 A * 1/1994 Carpenter ..... A61F 13/041 428/71
5,475,948 A * 12/1995 Parke ..... E06B 7/2316 49/470
6,548,163 B1 * 4/2003 Hills ..... B05B 12/26 428/343
6,560,932 B2 * 5/2003 Heroux ..... E06B 7/2316 49/467
6,685,252 B2 * 2/2004 Graf ..... B60J 10/25 296/108
7,360,769 B2 * 4/2008 Bennett ..... F01D 11/005 277/641
7,891,136 B1 * 2/2011 Heroux ..... E06B 7/2316 292/343
8,047,550 B2 * 11/2011 Behrens ..... E04B 1/948 277/630
8,541,084 B2 * 9/2013 Deiss ..... E04B 1/6809 428/119
8,733,019 B2 * 5/2014 Vulpitta ..... E06B 7/2316 49/70
2012/0023846 A1 2/2012 Mattox et al.
2012/0031032 A1 2/2012 Deiss et al.
2013/0031856 A1 2/2013 Pilz et al.
2013/0118102 A1 * 5/2013 Pilz ..... E04B 1/948 52/232
2015/0013254 A1 1/2015 Pilz et al.
2015/0135622 A1 * 5/2015 Muenzenberger ..... E04B 1/948 52/407.1

FOREIGN PATENT DOCUMENTS

DE 29822981 * 4/1999
DE 298 22 981 U1 5/1999
EP 2 415 942 A1 2/2012
WO 01/71123 9/2001

* cited by examiner

JOINT-SEALING TAPE WITH PREDETERMINED GEOMETRY AND SEALING ARRANGEMENT WITH SUCH JOINT SEALING TAPE

This application is a National Stage entry under § 371 of International Application No. PCT/EP2016/052464, filed on Feb. 5, 2016, and which claims the benefit of European Application No. 15155103.3, filed on Feb. 13, 2015.

FIELD OF THE INVENTION

The present invention relates to a joint-sealing tape for sealing of building structure joints, especially for sealing against sound and smoke and if applicable against fire. In particular, the invention relates to acoustic, smokeproof and/or fireproof sealing of connecting joints in drywalls, especially of expansion joints.

BACKGROUND OF THE INVENTION

Connecting joints are usually formed when different building parts meet. Connecting joints are found in the region of connection to the inter-story ceiling, to the floor and to massive walls. Due to weight loading or thermal influences, the ceiling in buildings may be forced upward or downward. To prevent damage to the drywall, the upper connecting joint in this case is made as an expansion joint. Thus joints for creating discontinuities in building parts in order to prevent stress cracking are known as expansion joints. The ceiling profile is made in such a way that a relative movement between ceiling profile and the vertical wall components is possible.

In general, a channel profile constituting part of the studwork is fastened to the connecting building parts. The gypsum boards themselves are attached at a well-defined spacing to the connecting building part. Usually sealing of the system is provided in the gap between gypsum board and ceiling. For this purpose, either a suitable sealing compound is introduced or else the gap is filled with mineral wool and provided at the surface with a sealing layer. In both cases, the material present in the joint presents relatively strong resistance to movement, with the consequence that comparatively large joint widths are necessary in order to achieve adequate movement absorption.

In particular, sealing of the gap with sealing compound has some disadvantages. It is particularly laborious, and in the course of time the sealing tends to crack when overloaded. Furthermore, sealing can be performed only after the gypsum boards have been mounted, and it requires access to the finished drywall from both sides. Furthermore, this procedure is error-prone, since the user himself or herself must dose the correct quantity of material in order to seal the gap adequately. Above and beyond this, the drywall builder must make the width of the joint correspond to the material and expansion properties of the sealing compound. During installation of the sealing compound, nothing but the joint can be filled. During expansion of the gap, it must be ensured that the sealing compound adheres sufficiently strongly to the underlying surface and that it is able to absorb the tensile forces that develop. Frequently this not the case, and the danger exists that the sealing compound will become detached from the underlying surface or that the sealing compound itself will be overloaded and tear. In the case of a narrower gap, the sealing compound can be compressed to only a limited extent, because of its material properties, and the danger exists that it will be forced out of the gap if the joint is incorrectly dimensioned. Due to the limited expansion and compression capability of the sealing compound (max. +/−25%), it is very important to ensure adequately large dimensioning of the spacing between gypsum board and ceiling. This is frequently underestimated, and so adequate imperviousness often cannot be guaranteed during use of customary sealing compounds.

Some further approaches exist for sealing of joints, especially joint cords or joint sprays, which to some extent suffer from the same disadvantages as have been described for sealing compounds.

The object of the invention is therefore to provide a joint-sealing tape that avoids the disadvantages of the known materials, that in particular is easier and safer to use, simplifies the mounting of further building parts, ensures good sealing as soon as it is applied and ensures excellent imperviousness with maximum absorption of movement.

A further object of the present invention is to provide an arrangement that, in the event of fire, permits better sealing of the joint between two building parts, especially between a drywall and a connecting building part, such as a wall, a ceiling or a floor, and thus provides better and durable sealing against sound and/or smoke and if necessary better and durable fire protection, and can be mounted reliably and free of defects with little work effort.

This and further objects that will become apparent from the description of the invention hereinafter are solved by the present invention, as described in the independent claims. The dependent claims relate to preferred embodiments.

SUMMARY OF THE INVENTION

The present invention relates to a joint-sealing tape for sealing a joint between a first building part and a second building part, with an elongated connecting element and at least two sealing elements, which are positioned on the connecting element, spaced apart, side-by-side and running in the longitudinal direction of the connecting element, which tape is characterized in that the sealing elements have a predetermined geometry. Preferably the sealing elements are positioned on the outer periphery of the connecting element.

Some other objects and features of this invention are obvious and some will be explained hereinafter. In particular, the subject matter of the present invention will be described in detail by reference to the following figures:

DETAILED DESCRIPTION OF THE INVENTION

Figure 1A:
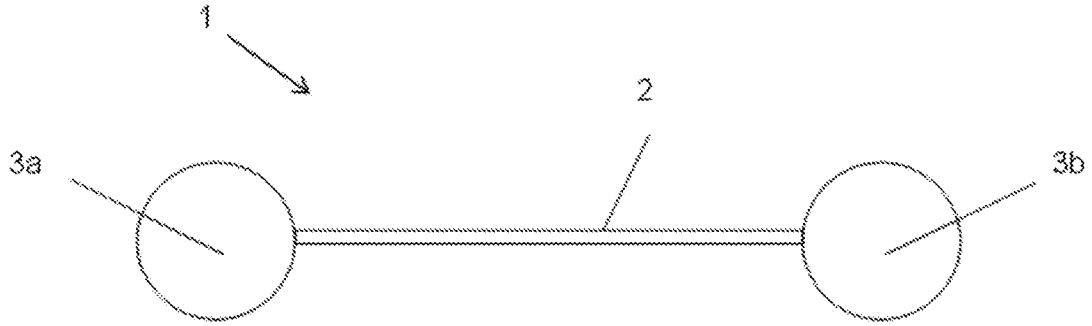
FIG. 1*a* shows a sketched front view of a joint-sealing tape according to one embodiment of the present invention, wherein the sealing elements have a solid profile and round profile.

The following terms are used within the scope of the present invention:

Within the scope of the present invention, the term "geometries" comprises various cross-section types and cross-section shapes. This means that the sealing elements in particular may have different cross-section types and cross-section shapes. Cross-section types are understood among other possibilities as round profile (round cross section), polygonal profile (polygonal cross section), especially square profile (square cross section), rectangular profile (rectangular cross section), parallelogram profile (cross section in the shape of a parallelogram), triangular profile (triangular cross section), etc. Cross-sectional shapes are understood among other possibilities as solid profile and hollow profile, wherein solid profile means that the sealing elements consist completely of sealing material while the hollow profile means that the sealing elements consist only partly of sealing material.

Within the scope of the present invention, the term "deformable" means that irregularities in the building part, against which the sealing element are pressed, can be evened out. In this connection, "plastically deformable" means that the sealing elements are deformable and no longer return to their original shape after deformation. Analogously, "elastically deformable" means that the sealing elements are deformable and return to their original shape after deformation, i.e. the material can be deformed reversibly to a certain extent.

The terms "exhibit", "with" and "have" are intended to be inclusive and mean that elements other than those cited may also be meant.

Within the scope of the present invention, the term "intumescence" means that, under the effect of heat, for example in the event of a fire, the material swells and forms an insulating layer of flame-retardant material, i.e. intumesces.

Within the scope of the present invention, "slow-burning foam" is understood as a foam that offers no possibility of fire propagation due to the foam, is not spontaneously flammable and also does not drip.

In this connection, "positioned in the outer region of the joint" means that these sealing elements are disposed on the first building part, especially laterally.

As used within the scope of the present invention, the singular forms "one", "a" and "an" also include the corresponding plural forms, unless something different can be inferred unambiguously from the relationship. Thus, for example, the term "one" is intended to mean "one or more" or "at least one", unless otherwise indicated.

In one aspect, the present invention relates to a joint-sealing tape for sealing a joint between a first building part and a second building part, with an elongated connecting element and at least two sealing elements, which are positioned on the connecting element, spaced apart, side-by-side and running in the longitudinal direction of the connecting element, which tape is characterized in that the sealing elements have a predetermined geometry.

In a further aspect, the present invention relates to a sealing arrangement for sealing a joint between two juxtaposed building parts, with at least one first building part, one second building part and the joint-sealing tape described in the foregoing, wherein the joint-sealing tape is positioned in the outer region of the joint and is configured to seal the joint from the outside.

It has been discovered that the inventive joint-sealing tape is particularly suitable for safely sealing, in simple manner, a building-structure joint between two adjacent building parts, especially against sound and/or smoke and if necessary also against fire. For the joint-sealing tape to be able to fulfill its function, sealing elements must have a predetermined geometry.

Therefore it is an objective of the present invention to describe the joint-sealing tape. In particular, it is an objective of the present invention to describe the geometry of the sealing elements and the connecting element of the joint-sealing tape in detail. Furthermore, it is an objective of the present invention to describe the positioning of the joint-sealing tape, especially a sealing arrangement.

The inventive joint-sealing tape for sealing a joint between a first building part and a second building part, with an elongated connecting element and at least two sealing elements, which are positioned on the connecting element, spaced apart, side-by-side and running in the longitudinal direction of the connecting element, is characterized in that the sealing elements have a predetermined geometry. As already mentioned hereinabove, geometries within the scope of the present invention comprise various cross-section types and cross-section shapes.

Preferred cross-section types of the sealing elements according to the present invention are solid profiles, wherein the hollow profile may be a closed or open hollow profile. Solid profiles and hollow profiles with large profile wall thicknesses have the advantage that automatically no gaps develop at the abutting surface between sealing elements in contact with one another. Hollow profiles can be compressed to a greater extent and thus absorb more movement. Particularly preferably, the sealing element has a solid profile. Particularly preferably, the sealing elements have a solid profile.

Preferred cross-section shapes of the sealing elements according to the present invention are round profile and polygonal profile, especially rectangular profile, square profile, parallelogram profile and triangular profile. Round profile and rectangular profile are particularly preferred, but rectangular profile is the most preferred. Nevertheless, other or mixed cross-section shapes are also conceivable and possible, as long as the sealing elements adjoin both building parts after installation of the joint-sealing tape and are able to close the joint that is present between the building parts. Preferably the sealing elements are positioned on the outer periphery of the connecting element.

In a preferred embodiment of the inventive joint-sealing tape, the sealing elements have a round profile.

In a further preferred embodiment of the inventive joint-sealing tape, the sealing elements have a rectangular profile.

In a particularly preferred embodiment of the inventive joint-sealing tape, the sealing elements have a solid profile and a round profile.

In a further particularly preferred embodiment of the inventive joint-sealing tape, the sealing elements have a solid profile and a rectangular profile.

The geometry of the sealing elements may be prefabricated, for example by well-defined cutting to size, extrusion or pressing of suitable sealing material or can be manufactured directly from flat material, for example by means of folding or rolling from a flat starting material, for example from fabric, especially from an incombustible material, such as inorganic fibers, for example glass fibers, a nonwoven fabric or the like. The manufacture of such cross-section types and cross-section shapes is known to the person skilled in the art. Preferably the geometry of the sealing elements is prefabricated by well-defined cutting to size or extrusion.

The inventive sealing elements may consist of one piece made from one material or of multiple parts made from several materials and, for example, may exist as a layered body. In alternative embodiments, the outer region and the inner region of a sealing element may define separate regions of the sealing element, which may have different cross-section shapes and/or cross-section types and/or may consist of different materials.

According to the invention, the sealing elements consist of a deformable material. This material may be either plastically or elastically deformable. In particular, the sealing elements consist at least partly, preferably completely of a material that is resilient after compression, such as foam, sponge rubber, cellular rubber or the like. The inventive sealing elements preferably consist of a soft foam that is resilient after compression. Common foams such as polyethylene and polyurethane foams or cellular rubber can be mentioned as foam material. This foam may be an open-celled foam with very low air passage resistance, or else an approximately closed-celled foam with extremely low air permeability values. Even foams with air permeability values lying between the two extreme cases mentioned in the foregoing may be used within the scope of the present invention. The foam may be impregnated with an impregnating agent that increases the sealing properties of the foam. In order to achieve imperviousness to smoke, at least the outer surface of the sealing element must be of closed-pore nature. Alternatively, an open-celled sealing element may be provided with a covering layer or jacket, for example of a film, especially plastic film. The covering layer or the jacket may be formed by the connecting element or by a separate material. Preferably, the sealing elements consist of an open-celled polyurethane foam or of a cellular rubber.

It has proved advantageous when the sealing elements consist of a slow-burning foam, such a cellular rubber or polyurethane foam, for example. In the case of a slow-burning foam, there is no possibility that fire will be propagated by the foam. Spontaneous inflammation is ruled out by the above-mentioned foam-type starting materials. It is also advantageous that no dripping occurs in the event of fire. A slow-burning foam should still have at least 20%, still at least 25%, preferably still at least 30%, between 20% and 60%, between 20% and 40%, preferably between 25% and 30% of its initial volume in a temperature range between 500° C. and 800° C. Furthermore, a slow-burning foam should still have at least 10%, at least 20%, preferably still at least 30%, between 10% and 40%, between 10% and 30%, preferably between 15% and 20% of its initial mass in a temperature range between 500° C. and 800° C.

Furthermore, the material may contain appropriate additives if fire protection properties such as intumescence, for example, are desired. Under the effect of heat, such as in the event of fire, the material swells and forms an insulating layer of flame-retardant material. The formation of a voluminous insulating layer, namely an ash layer, may take place due to the chemical reaction of a mixture of compounds that are appropriately matched to one another and that react with one another under the effect of heat. Such systems are known to the person skilled in the art as chemical intumescence, and they may be used according to the invention. Alternatively, the voluminous insulating layer may be formed by swelling of an individual compound, which releases gases under the effect of heat, even though no chemical reaction has occurred between two compounds. Such systems are known to the person skilled in the art as physical intumescence, and they may also be used according to the invention. According to the invention, the two systems may be used respectively alone or together as a combination.

In some embodiments, it is even sufficient when the connecting element alone is impervious to smoke and/or gases.

In a preferred embodiment of the inventive joint-sealing tape, the sealing elements consist of an open-celled foam.

In a further preferred embodiment of the inventive joint-sealing tape, the sealing elements consist of a closed-celled foam.

In a particularly preferred embodiment of the inventive joint-sealing tape, the sealing elements consist of an open-celled polyurethane foam.

In a further particularly preferred embodiment of the inventive joint-sealing tape, the sealing elements consist of a cellular rubber.

The connecting element may consist of a deformable material, which may be the same as that of the sealing elements, of a film, for example of a plastic film, of a fabric, especially of a noncombustible material, such as inorganic fibers, for example glass fibers, a nonwoven or the like. Preferably the connecting element consists of a film.

The connecting element may be made in one piece from one material or in multiple pieces, even from different materials. Preferably the connecting element is made in one piece.

The inventive joint-sealing tape may be made in one piece from one material or in multiple pieces, even from different materials. Preferably the joint-sealing tape consists of several units/materials. Particularly preferably, the sealing elements consist of deformable material and the connecting element of a film or fabric.

In one embodiment of the inventive joint-sealing tape, the sealing elements are firmly joined to the connecting element at least over part of their circumference. Hereby a firm joint is created between the connecting element and the sealing elements, so that, even under severe stress and strain of the fastening region and partial detachment of the sealing elements from the connecting element, complete detachment of the sealing elements from the connecting element is prevented.

In a further embodiment of the inventive joint sealing tape, the sealing elements are firmly joined to the connecting element over their entire circumference. On the one hand, optimum and durable fastening of the sealing elements to the connecting element is achieved hereby, thus making detachment of the sealing elements from the connecting element almost impossible. On the other hand, if the connecting element is smokeproof, an open-celled foam material may be used for the sealing elements.

The positioning of the sealing elements on the connecting element may be achieved by fastening means, for example in the form of an adhesive layer, especially a self-adhesive layer, in the form of interlocking or frictionally acting means, such as suitable profiled shapes, or by means of welding, such as thermal welding, for example, or ultrasonic welding, or the like. Positioning of the sealing elements on the connecting element by means of an adhesive layer or welding is preferred. For one-piece joint-sealing tapes, the positioning is predetermined by manufacturing factors.

The dimension and the material of the joint-sealing tape, especially both of the sealing elements and of the connecting element, are chosen to correspond to the planned use of the joint-sealing tape.

In general, the dimension of the sealing elements is chosen as a function of the profiles being used and of the material being used. The dimension must be chosen such that the sealing element fills the gap between the gypsum board and the ceiling and bears sealingly both on the ceiling and on the gypsum board. If a vertical movement of the gypsum boards is to be permitted, the sealing element must follow the movement of the gypsum board, so that the contact with the gypsum board is not torn apart and no gaps are able to form between sealing element and gypsum board. For this purpose, the sealing element preferably consists of resilient and compressible material and is appropriately precompressed during mounting of the gypsum board, so that a downward movement of the gypsum board, whereby the gap between this and the ceiling becomes larger, can be followed. In this way, the preadjusted freedom of movement of the gypsum board determines the width of the sealing element.

As an example, it must be pointed out that the height of the narrow side of rectangular sealing elements will be chosen as a function of the desired use of the sealing element, in which case the height for a single-boarded arrangement will be chosen as approximately the thickness of one gypsum board and the height for a double-boarded arrangement will be chosen as approximately twice the thickness of one gypsum board. In the case of a single-boarded arrangement, however, it is also possible to use the joint-sealing tape designed for a double-boarded arrangement.

As an example, it must also be pointed out that material and geometry of the sealing element may be chosen in such a way that its hardness or compressibility is adjusted such that the sealing element is compressed to a well-defined height merely by the dead weight of the gypsum board in the floor region, for example by constructing the sealing element as two layers of foam materials with different compression density. In this way a correct spacing between floor and gypsum board can be adjusted without further measurement. This is necessary in particular whenever damage to the gypsum board by rising dampness must be prevented.

The region of the connecting element disposed between the two sealing elements, or more accurately said between the two points of attachment of the connecting element to the sealing element, defines a support region, which consists only of the connecting element. This support region is dimensioned such that it corresponds at least to the width of the web of the channel profile. Hereby the installation and especially the positioning of the joint-sealing tape on the web of the channel profile is facilitated.

The positioning of the sealing elements on a building part may be achieved in one step by means of a connecting element. It is also possible that the connecting element and/or the sealing elements in turn may have means for fastening to a building part, such as a dry-construction profile, for example in the form of a self-adhesive layer, in the form of interlocking or frictionally acting means, such as suitable profiled shapes or the like, although individual positioning of the sealing elements is also a possible option. The inventive joint-sealing tape is preferably positioned on a building part in one step.

To create an inventive sealing arrangement, the inventive joint-sealing tape, before attachment of a first building part, is positioned on the first building part, and then fastened together therewith on a second building part in the usual way, e.g. by screws or nails. Preferably the first building part is a frame profile of a drywall studwork, for example a channel profile, and the second building part is a wall, a ceiling or a floor of a building structure. Particularly preferably, the first building part is a channel profile and the second building part is a ceiling. In this arrangement, the joint-sealing tape is positioned in the outer region of the joint and is configured to seal the joint from the outside.

In one option for sealing a connecting joint in dry construction, the joint-sealing tape, prior to attachment of the profile to the connecting building parts, such as a ceiling, for example, is positioned on a channel profile and then fastened together therewith on the ceiling. In a further operation, the gypsum boards, whether they have one or two layers, are pressed at the end face against the sealing element, so that, in the case of a double-boarded arrangement, the two gypsum boards come into contact via respectively their top edge with the sealing element, especially with the sealing strip, and thereby sealing of the joint is achieved. In order to permit movement of the gypsum boards without the formation of a gap between the sealing element and the gypsum board or the gypsum board(s) in the case of maximum movement, the sealing element must be compressed during mounting of the gypsum board(s).

For this purpose, the material and the thickness of the sealing element are respectively chosen such that the sealing element does not hinder the movement of the gypsum board(s) and, at maximum joint width, the top edge of the gypsum board(s) still remains in contact with the sealing element, in order to ensure adequate sealing against gases. The width of the sealing element is preferably chosen such that it corresponds approximately to twice the width of one gypsum board. It has been found that sufficient sealing may also be achieved when the width of the sealing element corresponds to the width of only one gypsum board.

When the joint-sealing tape is disposed on the channel profile and abutted with the ceiling, irregularities in both building parts can be evened out and simple positioning without adhesive bonding is possible. Furthermore, the joint spacing can be controlled by the subsequent positioning of the gypsum board as well as by the choice of sealing materials and/or geometric configuration of the joint-sealing tape.

Alternatively, when only one gypsum board is used, it may be mounted not from underneath in a manner abutting the sealing element, but instead in such a way that the gypsum board partly overlaps the sealing element. Thereby the gypsum board partly overlaps the sealing element, and the overlapping part of the sealing element is pressed between the channel profile and the gypsum board. It has been found that sufficient sealing can also be achieved hereby, especially against gases. To improve the imperviousness and/or the sliding properties, the sealing tape may be laminated on one side with a layer of material, such as a plastic film, for example, that neither hinders the movement of the gypsum board nor is destroyed by it. As an example, the positioning marking for the gypsum board may be easily applied on a film.

In this type of mounting, a large capacity for absorbing movement relative to the joint width is possible. Furthermore, this type is more mounting-friendly than the aforementioned single-boarded or double-boarded arrangement, since the gypsum board can be mounted simply on the sealing element without the need to measure the spacing. If positioning marking is used, the gypsum board can be mounted without measurement of the spacing. Above and beyond this, there is no need to use readily compressible materials for the sealing elements in this type of mounting, thus permitting relatively broad discretion in the choice of material.

In a further particularly preferred alternative, sealing of the joint can be achieved when, in the case of a double-boarded arrangement, the two gypsum boards are mounted with a horizontal offset in such a way that the outer of the two gypsum boards (also referred to as the outer, second gypsum board) is mounted higher (i.e. closer to the ceiling) than the inner gypsum board (also referred to as the inner, first gypsum board). In this embodiment, the thickness of the sealing element is chosen to correspond to the thickness of one gypsum board. The first, inner gypsum board is mounted in such a way that its top edge contacts the end faces of the sealing element, in which case zero or little precompression of the sealing element is necessary. The second, outer gypsum board is attached at a horizontal offset, i.e. it is mounted higher than the first, inner gypsum board, so that it partly overlaps the sealing strips. In this case the sealing element and the gypsum board should bear sealingly on one another, in order to seal the gap between the outer, second gypsum board and the sealing element, especially against gases. Thus sealing is achieved between sealing element and the second building part, such as a ceiling, a wall or a floor, as well as between sealing element and outer, second gypsum board.

An empty gap remains between the second building part, such as a ceiling, a wall or a floor, and the outer, second gypsum board. In the case of a vertical movement of the second building part or of the gypsum boards, this gap is completely available to absorb movement.

Depending on how far the outer, second gypsum board overlaps the sealing element (size of the offset), a movement in the other direction may also be absorbed. In this case, it is important that an overlap is still ensured between the second gypsum board and the sealing strip. Preferably, therefore, the dimension of the sealing element is chosen such that its thickness is somewhat larger than the thickness of one gypsum board and its height comprises somewhat more than the maximum permissible movement of the building parts (maximum joint width).

By the fact that the thickness of the sealing element is larger than the thickness of the gypsum board, the gypsum board is pushed against the sealing element and somewhat compressed while it is being mounted, whereby the gap between sealing element and gypsum board is reliably sealed, especially against gases.

For easier adjustment of the correct joint dimension in the outer, second gypsum board, markings referred to as positioning marking may be made laterally on the joint-sealing tape. To improve the imperviousness and/or the sliding properties, the sealing tape may be laminated on one side with a layer of material, such as a plastic film, for example, that neither hinders the movement of the gypsum board nor is destroyed by it. As an example, the positioning marking for the outer, second gypsum board may be easily applied on a film.

In this type of mounting, maximum absorption of movement relative to the joint width is possible. Furthermore, this type is very mounting-friendly, since firstly the first gypsum board can be mounted simply on contact with the sealing element without the need to measure the spacing. Secondly, especially if positioning marking is used, the second gypsum board can also be mounted without measurement of the spacing. Above and beyond this, the broadest possible discretion in the choice of material for the sealing elements is achieved by this type of mounting, since these are compressed only slightly and thus only slight requirements are imposed on the compressibility of the sealing element.

According to the invention, the joint-sealing tape can be on all kinds of connecting joints in which one building part meets another building part. Accordingly, the joint-sealing tape may be used on all profiles, even closed profiles or wooden beams, which must be sealed to a connecting face.

A particularly preferred use of the joint-sealing tape therefore relates to the sealing of profiles in dry construction, wherein the first building part is a floor, a ceiling or a wall of a building element, for example a masonry structure or concrete building element, and the second building part is a ceiling, floor or wall profile or a metal or wood studwork of a dry construction element. The profile may be any of the profiles commonly used for dry construction, regardless of whether it has a slotted or non-slotted web or slotted or non-slotted flange. The further building parts are gypsum boards, which bear closely on the profiles and are fastened to the studwork. In order to permit vertical movement of the gypsum boards, for example in the event of an earthquake, the gypsum boards are mounted to be vertically movable at a spacing from a wall, a floor or a ceiling. Thereby a space (also referred to as joint herein) is formed between the gypsum board and the wall, the floor or the ceiling. This joint is filled by the sealing element of the joint-sealing tape, so that the sealing element seals the joint against sound and/or smoke and, depending on material of the sealing strip, also against fire if necessary. For the joint-sealing tape to be able to fulfill its function, the sealing elements must have a predetermined geometry.

Without restricting the scope of protection of the invention, the invention will be described in more detail on the basis of special embodiments of the joint-sealing tape. In these embodiments, the joint-sealing tape is applied to the connecting joints in drywalls. It is clear to the person skilled in the art that the sealing tape may also be applied to building-structure joints of other types.

Figure 1B:
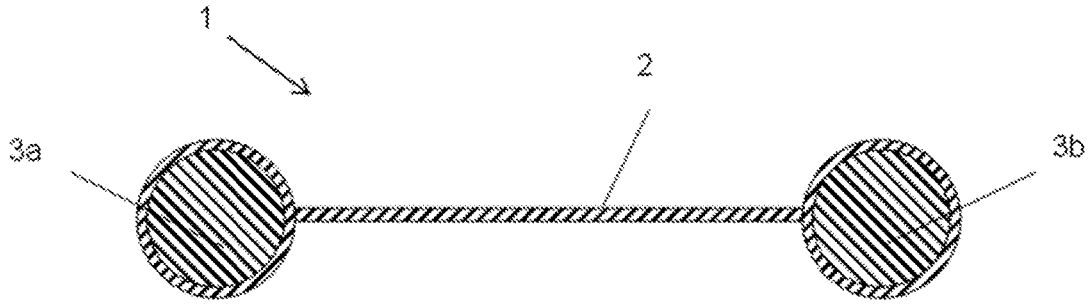
FIG. 1*b* shows a cross section through a joint-sealing tape according to one embodiment of the present invention, wherein the sealing elements have a solid profile and round profile.
Figure 1C:
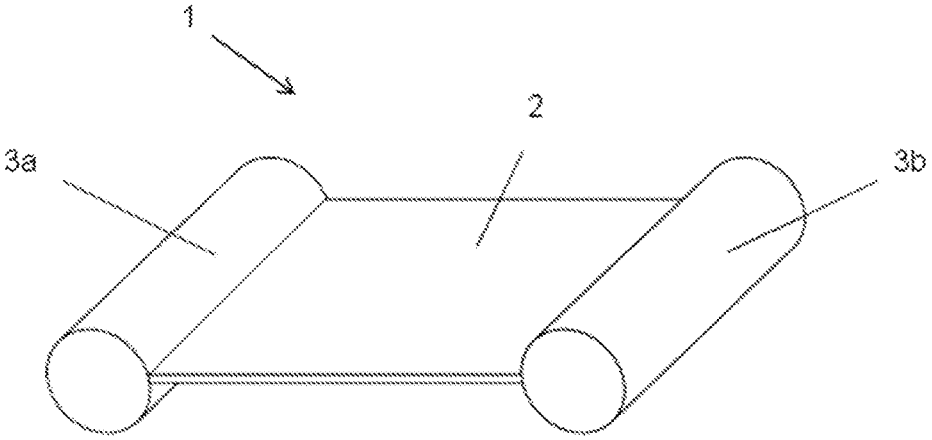
FIG. 1*c* shows a perspective view of a joint-sealing tape according to one embodiment of the present invention, wherein the sealing elements have a solid profile and round profile.

A preferred embodiment of an inventive joint-sealing tape 1 is shown in FIGS. 1*a* to 1*c*. Joint-sealing tape 1 has two sealing elements 3*a* and 3*b*, which are positioned on the outer peripheries of connecting element 2. Sealing elements 3*a* and 3*b* have a round profile and a solid profile, wherein connecting element 2 is positioned laterally on round sealing elements 3*a* and 3*b*. Furthermore, sealing elements 3*a* and 3*b* are completely surrounded, i.e. over their entire circumference, by connecting element 2. Sealing elements 3*a* and 3*b* consist of a compressible foam, which if necessary contains fire-protection additives, and connecting element 2 consists of a plastic film.

Figure 2A:
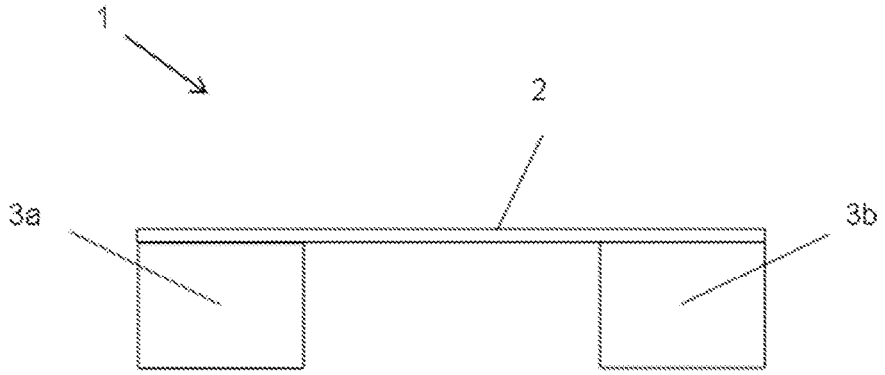
FIG. 2*a* shows a sketched front view of a joint-sealing tape according to one embodiment of the present invention, wherein the sealing elements have a solid profile and rectangular profile.
Figure 2B:
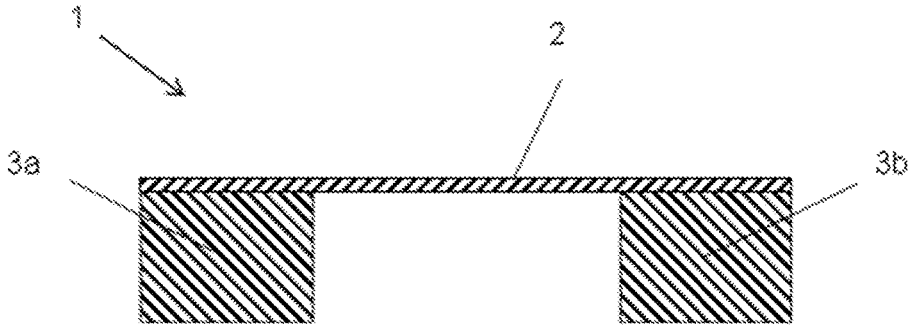
FIG. 2*b* shows a cross section through a joint-sealing tape according to one embodiment of the present invention, wherein the sealing elements have a solid profile and rectangular profile.
Figure 2C:
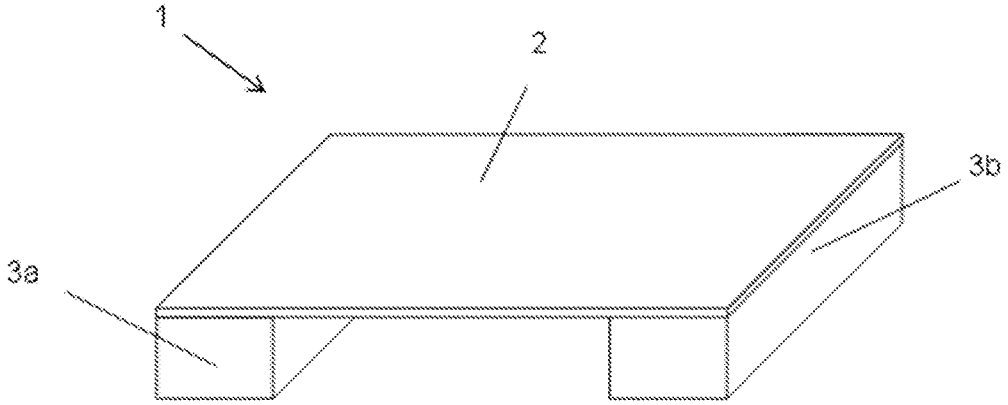
FIG. 2*c* shows a perspective view of a joint-sealing tape according to one embodiment of the present invention, wherein the sealing elements have a solid profile and rectangular profile.

A further preferred embodiment of an inventive joint-sealing tape 1 is shown in FIGS. 2*a* to 2*c*. Joint-sealing tape 1 has two sealing elements 3*a* and 3*b*, which are positioned on the outer peripheries of connecting element 2. Sealing elements 3*a* and 3*b* have a solid profile and rectangular profile, wherein connecting element 2 is positioned on top on the broad side of rectangular sealing elements 3*a* and 3*b*. Each of the sealing elements 3*a* and 3*b* has two opposite broad sides as well as respectively two narrow sides running transversely relative to the broad sides and connecting them, and respectively one broad side is provided for application on the second building part and respectively one of the narrow sides is provided for application on the first building part. Furthermore, sealing elements 3*a* and 3*b* are partly surrounded by connecting element 2. Sealing elements 3*a* and 3*b* consist of a compressible foam, which if necessary contains fire-protection additives, and connecting element 2 consists of a plastic film.

Figure 3A:
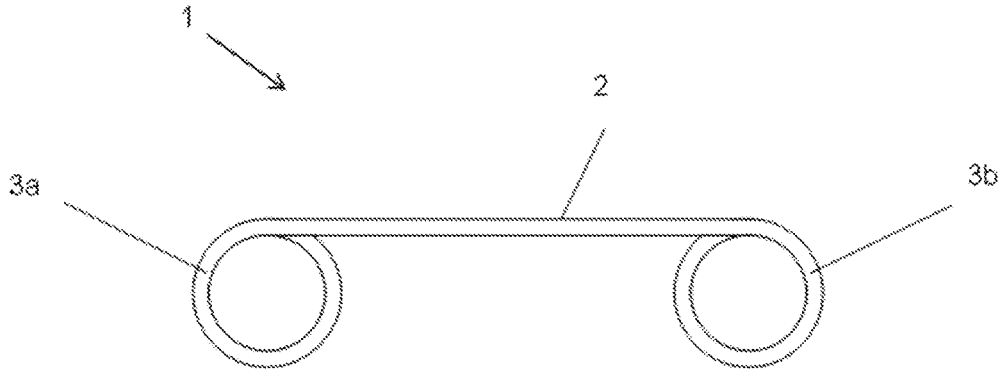
FIG. 3*a* shows a sketched front view of a joint-sealing tape according to one embodiment of the present invention, wherein the sealing elements have a closed hollow profile and round profile.
Figure 3B:
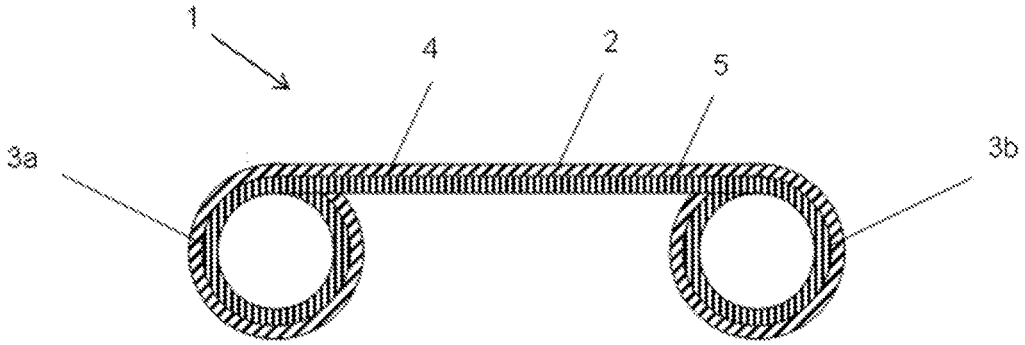
FIG. 3*b* shows a cross section through a joint-sealing tape according to one embodiment of the present invention, wherein the sealing elements have a closed hollow profile and round profile and additionally an intumescent layer.
Figure 3C:
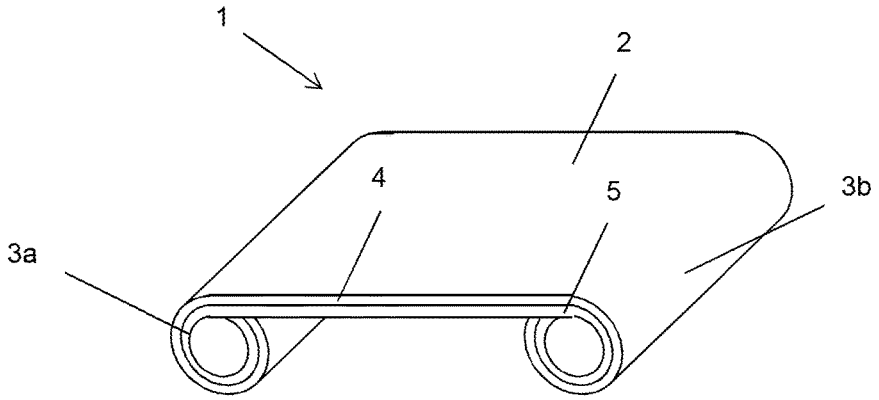
FIG. 3*c* shows a perspective view of a joint-sealing tape according to one embodiment of the present invention, wherein the sealing elements have a closed hollow profile and round profile and additionally an intumescent layer.

A further preferred embodiment of an inventive joint-sealing tape 1 is shown in FIGS. 3*a* to 3*c*. Joint-sealing tape 1 has two sealing elements 3*a* and 3*b*, which are positioned on the outer peripheries of connecting element 2. Sealing elements 3*a* and 3*b* have a round profile, wherein connecting element 2 is positioned on top on round sealing elements 3*a* and 3*b*. Furthermore, sealing elements 3*a* and 3*b* have a closed hollow profile. Connection element 2 and sealing elements 3*a* and 3*b* are made in one piece and consist of a compressible foam 4. Connection element 2 and sealing elements 3*a* and 3*b* are additionally coated on one side with an intumescent layer 5.

Figure 4A:
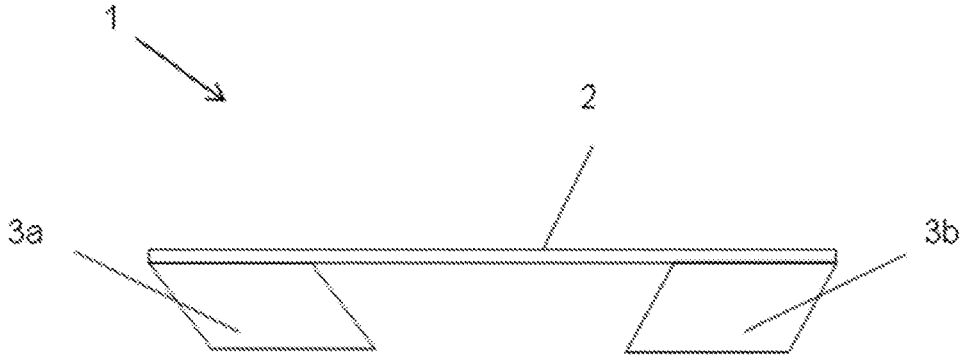
FIG. 4*a* shows a sketched front view of a joint-sealing tape according to one embodiment of the present invention, wherein the sealing elements have a solid profile and rectangular profile, especially a parallelogram profile.
Figure 4B:
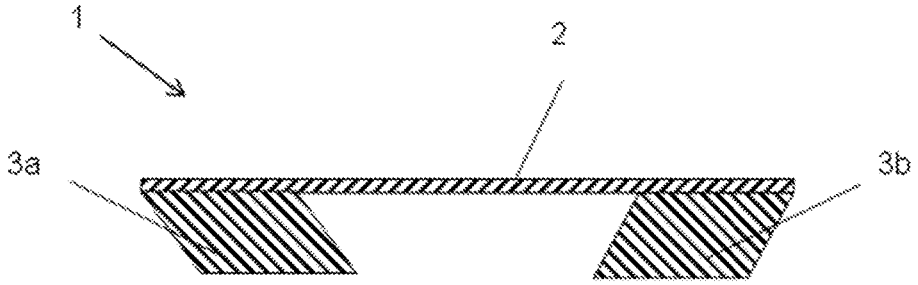
FIG. 4*b* shows a cross section through a joint-sealing tape according to one embodiment of the present invention, wherein the sealing elements have a solid profile and rectangular profile, especially a parallelogram profile.
Figure 4C:
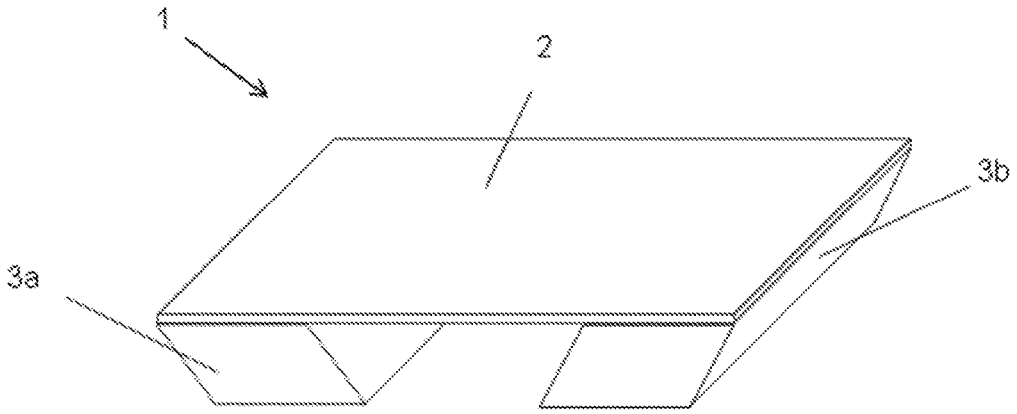
FIG. 4*c* shows a perspective view of a joint-sealing tape according to one embodiment of the present invention, wherein the sealing elements have a solid profile and rectangular profile, especially a parallelogram profile.

A further preferred embodiment of an inventive joint-sealing tape 1 is shown in FIGS. 4*a* to 4*c*. Joint-sealing tape 1 has two sealing elements 3*a* and 3*b*, which are positioned on the outer peripheries of connecting element 2. Sealing elements 3*a* and 3*b* have a solid profile and rectangular profile, especially a parallelogram profile, wherein connecting element 2 is positioned on top on the broad side of rectangular sealing elements 3*a* and 3*b*. Furthermore, sealing elements 3*a* and 3*b* are partly surrounded by connecting element 2. Sealing elements 3*a* and 3*b* consist of a compressible foam, which if necessary contains fire-protection additives, and connecting element 2 consists of a plastic film.

Figure 5A:
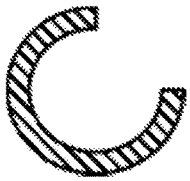
FIGS. 5*a* to 5*h* show further examples of geometric embodiments of sealing elements 3*a* and 3*b* in cross section.
Figure 5B:
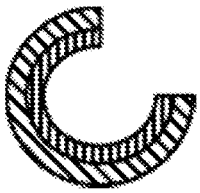
Figure 5C:
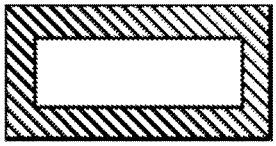
Figure 5D:
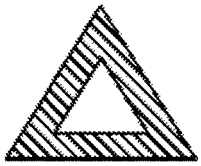
Figure 5E:
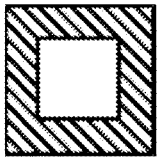
Figure 5F:
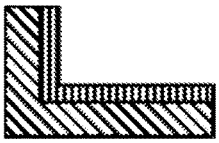
Figure 5G:
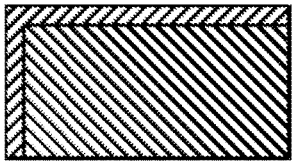
Figure 5H:
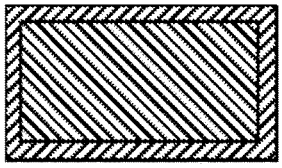

FIGS. 5*a* to 5*h* show further examples of geometric embodiments of sealing elements 3*a* and 3*b*. Sealing element 3*a*/3*b* in FIG. 5*a* has an open hollow profile and round profile. Sealing element 3*a*/3*b* in FIG. 5*b* has an open hollow profile and round profile with additional intumescent layer. Sealing element 3*a*/3*b* in FIG. 5*c* has a closed hollow profile and rectangular profile. Sealing element 3*a*/3*b* in FIG. 5*d* has a closed hollow profile and triangular profile. Sealing element 3*a*/3*b* in FIG. 5*e* has a closed hollow profile and square profile. Sealing elements 3*a*/3*b* in FIGS. 5*c* to 5*e* are also possible as a solid profile. Sealing element 3*a*/3*b* in FIG. 5*f* has an open hollow profile and polygonal profile with additional intumescent layer. Sealing element 3*a*/3*b* in FIGS. 5*g* and 5*h* has a solid profile and rectangular profile, wherein the sealing element is firmly jacketed at least over part of its circumference by connecting element (2) (FIG. 5*g*) or is firmly jacketed over its entire circumference by connecting element (2) (FIG. 5*h*). Jacketing may be provided partly or completely in all geometric embodiments of sealing elements 3*a* and 3*b*.

Any geometric as well as material configuration of the sealing elements and of the connecting element mentioned in the foregoing can be combined and used in any way in order to provide a joint-sealing tape according to the present invention.

Figure 6:
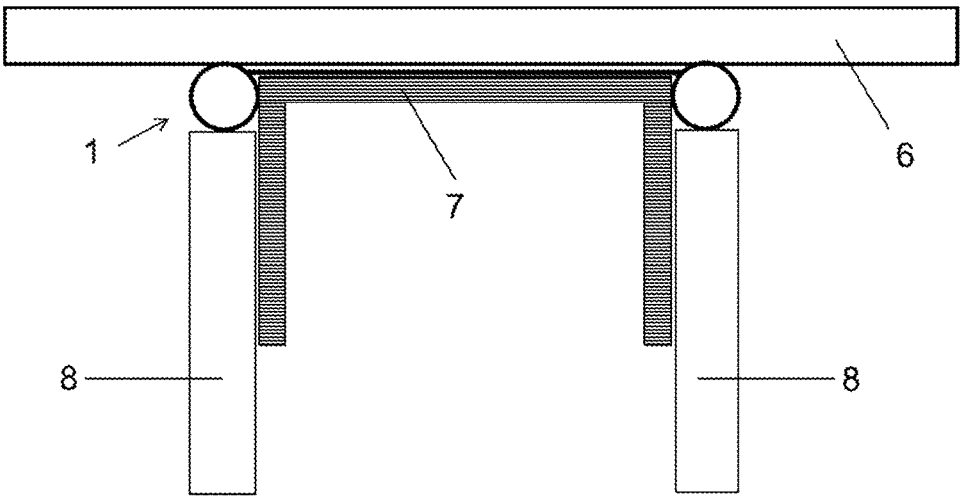
FIG. 6 sketches a sectional view through a finished building element with the embodiment of an inventive sealing arrangement shown in FIGS. 1*a* to 1*c*.

A sectional view through a finished building element with the embodiment of an inventive sealing arrangement shown in FIGS. 1*a* to 1*c* is sketched in FIG. 6. In particular, FIG. 6 shows the positioning of an embodiment of the inventive joint-sealing tape 1 in a connecting joint of drywalls. To seal the gap between a ceiling 6, channel profile 7 of a drywall studwork and gypsum boards 8, in the first step, joint-sealing tape 1 is laid on the web of channel profile 7 and, in the second step, is fastened together therewith on ceiling 6 in the usual way, e.g. by screws or nails. Then, in a last step, gypsum boards 8 are applied on the flange of channel profile 7 and pushed upward in the direction of ceiling 6, whereupon a gap remains between the top edge of gypsum board 8 and ceiling 6, which is filled with sealing elements 3*a* and 3*b* of joint-sealing tape 1, in order to permit vertical movement, for example, of gypsum board 8. Thereby sealing elements 3*a* and 3*b* are compressed and thus seal the gap between ceiling 6 and channel profile 7 and the gap between ceiling 6 and gypsum board 8.

As is obvious from the foregoing explanations, the inventive joint-sealing tape is particularly suitable for safely sealing a building-structure joint between two adjacent building parts in simple manner, especially against sound and/or smoke and if necessary also against fire.

Furthermore, application is very mounting-friendly, since no additional fastening of the joint-sealing tape, for example to the profile or to the ceiling, is necessary. Accurately fitting application of the joint-sealing tape, for example against a profile, is also unnecessary, by virtue of the self-centering of the joint-sealing tape during mounting of the profile on a building part. Mounting is therefore conceivably easy, and the working effort for mounting the joint-sealing tape is greatly reduced. The invention therefore achieves safe and reliable sealing of joints between two building parts, especially between a profile of a drywall studwork and a building part adjacent thereto, such as, for example, a ceiling, wall or floor. In this connection, two-sided sealing can be achieved in only one operation, by providing a prefabricated sealing element.

Furthermore, it has been shown that outstanding imperviousness can be achieved with the inventive joint-sealing tape, since good compressibility of the sealing elements is ensured without additional auxiliary means by the choice of the sealing materials and/or geometric configuration. By appropriate choice of the sealing materials and/or geometric configuration, the invention also makes it possible to adjust the correct spacing of gypsum board from the connecting building part without additional auxiliary means, in order to achieve the said precompression.

By means of the inventive joint-sealing tape it is also possible to ensure that, merely by the choice of the sealing materials and/or geometric configuration, sufficient material is installed to ensure excellent imperviousness with maximum absorption of movement.

Furthermore, with the inventive joint-sealing tape, irregularities of the surface of a building part can be reliably sealed as soon as one building part is disposed on another building part, since the sealing elements of the joint-sealing tape are pressed sufficiently firmly against the surface of the one building part and at the same time against the side faces of the other building part.

In view of the foregoing, it is obvious that the objects of the invention have been solved. Since various modifications can be made to the joint-sealing tape described hereinabove, without departing from the scope of the invention, it is intended that all subject matters contained in the foregoing description be interpreted as illustrative and not in a restrictive sense.

The invention claimed is:

1. A joint-sealing tape for sealing a joint between a first building part and a second building part, said joint-sealing tape comprising:

an elongated connecting element, and at least two sealing elements which are positioned on the connecting element, spaced apart, side-by-side and running in the longitudinal direction of the connecting element, wherein the sealing elements have a predetermined geometry, the sealing elements consist of a deformable material of an intumescent material;

and the sealing elements are positioned only on an outer periphery and on the same side of said connecting element.

2. A joint-sealing tape according to claim 1, wherein the sealing elements are firmly joined to the connecting element at least over part of their circumference.

3. The joint-sealing tape according to claim 2, wherein the sealing elements are firmly joined to the connecting element over their entire circumference.

4. The joint-sealing tape according to claim 1, wherein the sealing elements have a solid profile or hollow profile.

5. The joint-sealing tape according to claim 1, wherein the sealing elements have a round profile or polygonal profile.

6. The joint-sealing tape according to claim 1, wherein the sealing elements consist of one piece made from one material or of multiple parts made from several materials and exist as a layered body.

7. The joint-sealing tape according to claim 1, wherein the connecting element consists of a deformable material, of a plastic film, of a fabric, or of a nonwoven.

8. A sealing arrangement for sealing a joint between two juxtaposed building parts, said sealing arrangement comprising:

at least one first building part, one second building part and a joint-sealing tape according to claim 1, wherein the sealing elements are positioned in the upper region of the joint and are configured to seal the joint from outside.

9. The sealing arrangement according to claim 8, wherein the sealing elements are disposed laterally on the first building part.

10. The sealing arrangement according to claim 8, wherein the first building part is a frame profile of a drywall and the second building part is a wall, a ceiling or a floor of a building structure.

11. A joint-sealing tape for sealing a joint between a first building part and a second building part, said joint-sealing tape comprising: an elongated connecting element, and at least two sealing elements which are positioned on the connecting element, spaced apart, side-by-side and running in the longitudinal direction of the connecting element, wherein the sealing elements have a predetermined geometry, the sealing elements consist of a deformable material of a slow-burning foam; and the sealing elements are positioned only on an outer periphery and on the same side of said connecting element.

12. The joint-sealing tape according to claim 11, wherein the sealing elements have a solid profile and round profile, the connecting element consists of a plastic film and the sealing elements consist of an open-celled polyurethane foam.

13. The joint-sealing tape according to claim 11, wherein the sealing elements have a solid profile and rectangular profile, the connecting element consists of a plastic film and the sealing elements consist of an open-celled polyurethane foam.

14. The joint-sealing tape according to claim 11, wherein the sealing elements have a solid profile and round profile, the connecting element consists of a plastic film and the sealing elements consist of a cellular rubber.

15. The joint-sealing tape according to claim 11, wherein the sealing elements have a solid profile and rectangular profile, the connecting element consists of a plastic film and the sealing elements consist of a cellular rubber.

16. The joint-sealing tape according to claim 11, wherein the sealing elements have a solid profile and rectangular profile, the connecting element consists of a glass-fiber fabric and the sealing elements consist of an open-celled polyurethane foam.

17. The joint-sealing tape according to claim 11, wherein the sealing elements have a solid profile and rectangular profile, the connecting element consists of a glass-fiber fabric and the sealing elements consists of a cellular rubber.

* * * * *